US007418807B1

(12) United States Patent
Ryan et al.

(10) Patent No.: US 7,418,807 B1
(45) Date of Patent: Sep. 2, 2008

(54) DECKING

(75) Inventors: Thomas G. Ryan, N. Huntingdon, PA (US); Donald H. Landis, Murrysville, PA (US)

(73) Assignee: Epic Metals Corporation, Rankin, PA (US)

( * ) Notice: Subject to any disclaimer, the term of this patent is extended or adjusted under 35 U.S.C. 154(b) by 777 days.

(21) Appl. No.: 10/857,538

(22) Filed: May 28, 2004

(51) Int. Cl.
*E04H 12/00* (2006.01)
*E04C 3/30* (2006.01)

(52) U.S. Cl. ..... 52/731.2; 52/650.1; 52/650.3; 52/654.1; 52/731.3; 52/737.6

(58) Field of Classification Search ..... 52/234, 52/283, 289, 481.3, 578, 588.1, 592.1, 650.1, 52/650.3, 654.1, 731.2, 731.3, 737.6, 793.1; 14/73, 73.1
See application file for complete search history.

(56) References Cited

U.S. PATENT DOCUMENTS

| | | | | | |
|---|---|---|---|---|---|
| 2,899,028 | A | | 8/1959 | Walker | |
| 2,975,874 | A | | 3/1961 | Pagan | |
| 3,312,034 | A | * | 4/1967 | Steinmann | 52/732.3 |
| 3,698,149 | A | | 10/1972 | Baker et al. | |
| 3,757,485 | A | | 9/1973 | Vincens | |
| 4,201,026 | A | | 5/1980 | Murphy | |
| 4,570,402 | A | * | 2/1986 | Johnson | 52/241 |
| 4,987,717 | A | | 1/1991 | Dameron, Jr. | |
| 5,205,098 | A | * | 4/1993 | Landis et al. | 52/336 |
| 5,491,943 | A | * | 2/1996 | Vondrejs et al. | 52/239 |
| 5,514,432 | A | | 5/1996 | Lisec | |
| 5,692,345 | A | * | 12/1997 | Mogaki et al. | 52/483.1 |
| 5,737,892 | A | * | 4/1998 | Greenberg | 52/469 |
| 5,791,100 | A | | 8/1998 | Schieferly et al. | |
| 5,901,528 | A | * | 5/1999 | Richardson | 52/783.1 |
| 5,903,943 | A | * | 5/1999 | Sherrod | 14/2.4 |
| 5,964,070 | A | * | 10/1999 | Redl et al. | 52/581 |
| 6,141,935 | A | | 11/2000 | Artner et al. | |
| 6,374,558 | B1 | | 4/2002 | Surowiecki | |
| 2001/0017016 | A1 | * | 8/2001 | Rudduck | 52/481.1 |
| 2002/0088194 | A1 | | 7/2002 | Ray | |
| 2003/0126827 | A1 | | 7/2003 | Davis | |

OTHER PUBLICATIONS

Epic Metals Corporation, "A Study of the Epicore Composite Floor System in Hospital Construction," Mar. 12, 1996, pp. 1-2.
Epic Metals Corporation, "Composite Floor Decks," © 1981, pp. 1-2.

* cited by examiner

*Primary Examiner*—Richard E. Chilcot, Jr.
*Assistant Examiner*—Branon C Painter
(74) *Attorney, Agent, or Firm*—The Webb Law Firm

(57) ABSTRACT

A long-span decking panel that includes a first panel section, a second panel section, a first channel and a second channel which form a cell. The first panel section includes a first open channel and a first side flange integrally extending from a first edge of the first open channel and a second side flange integrally extending from a second edge of the first panel section. The second panel section includes a second open channel, a first side flange integrally extending from a first edge of the second open channel and a second side flange integrally extending from a second edge of the second open channel. The first channel and the second channel include a panel and two depending legs. Also disclosed is a system incorporating the long-span decking panels and methods for manufacturing the panels and the systems.

41 Claims, 5 Drawing Sheets

DECKING

BACKGROUND OF THE INVENTION

1. Field of the Invention

The present invention is related to decking and, more specifically, to decking panels capable of spanning extended lengths.

2. Description of the Prior Art

In the past, metal decking has been used to provide roofing and flooring for many structures such as airports, universities and hospitals. Metal decking is lightweight and strong. The industry keeps placing greater demands on the decking manufacturers in an effort to create longer spanning and stronger decking. Of course, extremely long spans can be created through structured steel members such as steel beams and steel trusses, etc. However, these components are relatively expensive to manufacture and are heavy when compared to metal decking, which can either be made from rolled sheet metal as individual panels interconnected with each other or a contiguous corrugated metal sheet, and have little aesthetic and/or little sound-absorbing value.

Metal decking panels were generally limited to depths of 7½ to 8 inches. This was due to rolling capabilities of the mills used to form the decking panels. In this size, generally, the spanning lengths of the decking panels could not extend greater than 32 feet. Subsequently, a long-span decking panel, U.S. Pat. No. 5,205,098, was invented which solved many of the problems of the prior art decking panels when extending greater lengths. Essentially, the long-span decking panel includes a top hat attached to a bottom hat section forming a panel cell. Adjacent panel cells interlock together utilizing a hook and tab arrangement. Each of the cells typically has a maximum depth of 7½ to 8 inches. This results in a beam-like structure having a maximum depth of between 15 and 16 inches. A panel made in accordance with the teachings of U.S. Pat. No. 5,205,098 and made of 14-gauge steel could cover a distance up to 60 feet. Such metal decking has been sold under the trademark SUPER WIDECK® by the assignee of the present application.

Although the SUPER WIDECK® panels have resulted in longer spans, the need has increased for even longer spans between support structures. Although, in theory, the depths of the top hats and bottom hats of the SUPER WIDECK® panels could be increased, there would be substantial tooling costs involved. Further, new types of rolling mills and a new type of rolling mill technology would be needed to form such deep deck profiles. These added costs would make the decking panel costs prohibitively expensive.

Therefore, it is an object of the present invention to create an inexpensive decking having depths greater than 16 inches.

SUMMARY OF THE INVENTION

The present invention is a long-span decking panel that includes a first panel section, a second panel section, a first channel and a second channel. The first panel section includes a first open channel, a first side flange integrally extending from a first edge of the first open channel and a second side flange integrally extending from a second edge of the first panel section. The second panel section includes a second open channel, a first side flange integrally extending from a first edge of the second open channel and a second side flange integrally extending from a second edge of the second open channel. The first channel includes a panel having two depending legs. The second channel has a panel and two depending legs, wherein the first side flange of the first panel section and the first side flange of the second panel section are fixedly secured through respective ones of the depending legs of the first channel and the second side flange of the first panel section and the second side flange of the second panel section are fixedly secured to respective ones of the depending legs of the second channel, so that the first panel section, second panel section, first channel and second channel form a cell. Adjacent long-span decking panels can be interconnected to each other through spaced apart male and female connectors. In this arrangement, the long-span decking panel forms a decking system wherein opposite ends of the interconnected long-span decking panels are supported by structural elements.

The present invention is also disclosed as a system for manufacturing the long-span decking panels and systems incorporating the long-span decking panels.

DESCRIPTION OF THE PREFERRED EMBODIMENTS

Figure 1:
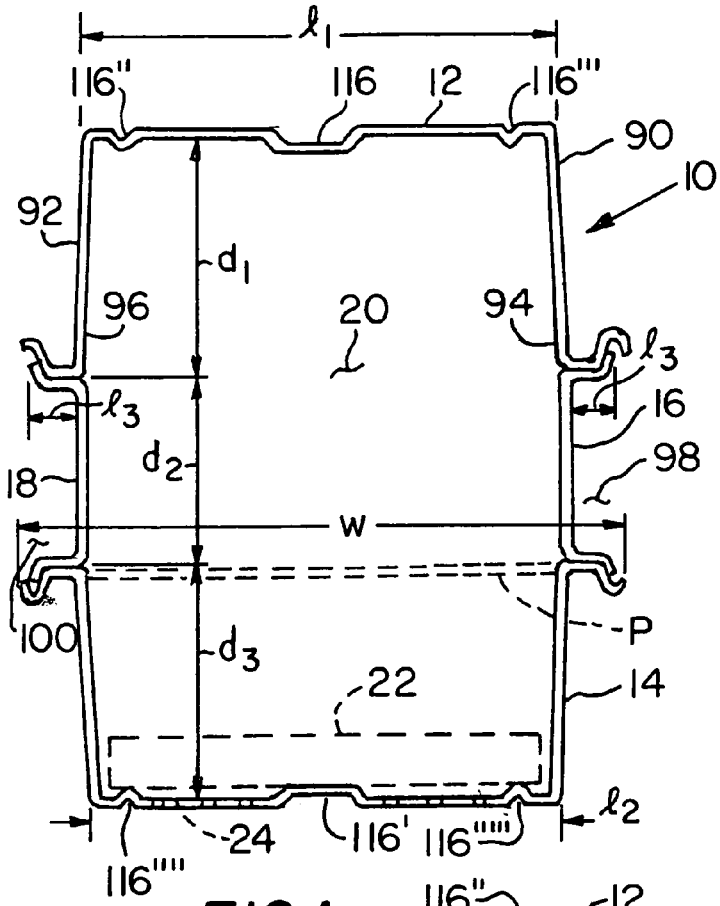
FIG. 1 is an end elevational view of a decking panel made in accordance with the present invention.
Figure 2:
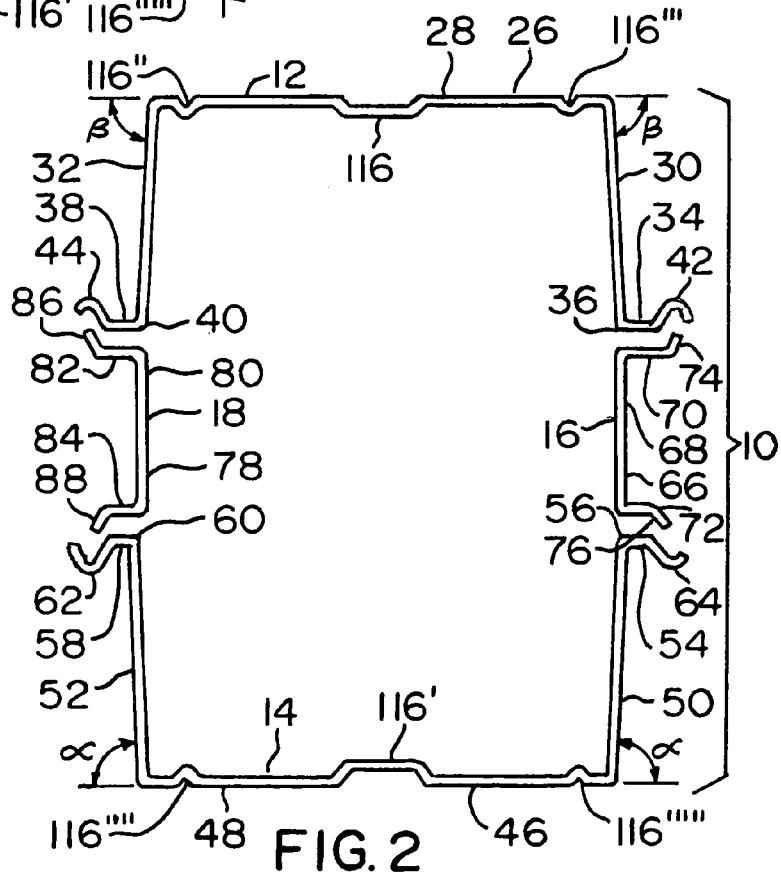
FIG. 2 is an exploded end elevational view of the decking panel shown in FIG. 1.

FIGS. 1 and 2 show a long-span decking panel 10, such as used in decking, made in accordance with the present invention. Specifically, the decking panel 10 includes a first panel section or top hat 12 attached to a second panel section or bottom hat 14 through a respective outwardly facing first channel 16 and an outwardly facing second channel 18 forming a cell. A cavity 20 is defined by the secured first panel section 12, the second panel section 14, the first channel 16 and the second channel 18. As can be seen, the first channel 16 and second channel 18 are spaced from each other and sandwiched between the first panel section 12 and second panel section 14. Optional insulation 22 (shown in phantom) may be received within the cavity 20 and rest upon an inner surface of the second panel section 14. Further, perforations 24, as shown in phantom, may be provided in the bottom section of the second panel section 14. The insulation 22 is typically a sound-absorbing material which is well known in the art.

Referring to FIG. 2, the first panel section 12 includes a first panel U-shaped open channel section body 26 that includes a top member 28 having legs 30 and 32 depending therefrom. The legs 30 and 32 define sides of the first panel section 12. A first side flange 34 integrally extends or depends from the leg 30 at an edge 36 thereof. Likewise, a second side flange 38 integrally extends or depends from leg 32 at an edge 40 thereof. A hook or female connector 42 is defined on flange 34 and a tab or male connector 44 depends from flange 38. The second panel section 14 includes a second panel U-shaped open channel section body 46 having a bottom member 48 with legs 50 and 52 depending therefrom. The legs 50 and 52 define sides of the second panel U-shaped section body 46. A first side flange 54 integrally extends or depends from the leg 50 at an edge 56 thereof. Likewise, a second side flange 58 integrally extends or depends from an edge 60 of leg 52. The flange 58 defines a hook or female connector 62. Flange 54 defines a tab or male connector 64.

The first channel 16 includes a C-shaped body 66 that includes a panel section 68 having two depending legs 70 and 72. Tabs 74 and 76 depend from legs 70 and 72, respectively. The second channel 18 includes a C-shaped body 78 having a panel section 80 with depending legs 82 and 84. Tabs 86 and 88 depend from legs 82 and 84, respectively.

Figure 4:
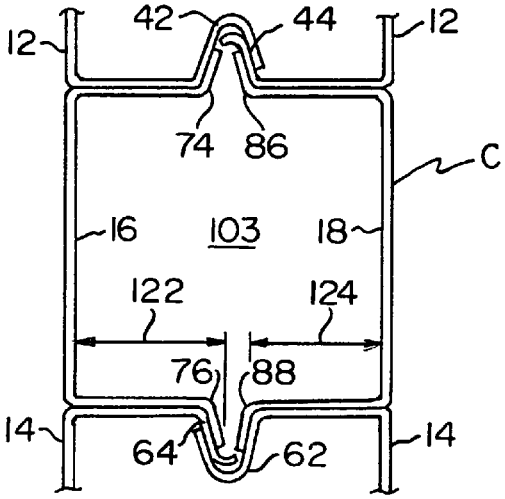
FIG. 4 is a partial elevational view of a decking system showing two adjacent decking panels coacting with each other.

Referring to FIGS. 2 and 4, the tabs 74, 88, 76 and 86 coact or mate with respective surfaces of the hooks 42 and 62 and the tabs 44 and 64. Further, respective legs 70, 72, 82 and 84 are fixedly secured or fastened to respective flanges 34, 54, 38 and 58 by welding, screws, rivets or any other fastening means to secure the first panel section 12 to the second panel section 14 via the first channel 16 and second channel 18 thereby forming a cell or the decking panel 10 in an assembled state. In the assembled state, the hook 42 and tab 44 are defined not only by the first panel section 12, but also by tabs 74 and 86 of channels 16 and 18. Likewise, hook 62 and tab 64 are defined not only by the second panel section 14, but also by tabs 76 and 88 of channels 16 and 18.

As shown in FIG. 1, the decking panel 10 in the assembled state defines a first side 90 which includes portions of first panel section 12, second panel section 14 and first channel 16 and a second side 92 which includes portions of first panel section 12, second panel section 14 and second channel 18. As shown in FIG. 2, the legs 70, 72, 82 and 84 of the first channel 16 and the second channel 18 coact with portions of the first panel section 12 and the second panel section 14. The first side 90 includes leg 30, panel section 68 and leg 50. The second side 92 includes the leg 32, panel section 80 and the leg 52. The first side 90 extends along a first surface 94 and the second side 92 extends along a second surface 96. These surfaces need not be flat, vertical surfaces. Specifically, the legs 32 and 30 may extend outwardly an angle $\beta$ and the legs 50 and 52 may extend outwardly an angle $\alpha$. For example angles $\alpha$ and $\beta$ could be on the order of 87°. The angles $\alpha$ and $\beta$ can preferably be within the range of 45°-90°. Preferably, angles $\alpha$ and $\beta$ are the same and the lengths of the legs 30, 32, 50 and 52 are equal. However, that is not necessarily required under the present invention. As can be seen, the first side 90 includes the hook or female connector 42 spaced from the tab or male connector 64; and the second side 92 includes the tab or male connector 44 spaced from the hook or female connector 62. As shown in FIG. 4, the male connectors 44 and 64 are adapted to mate or coact with female connectors 42 and 62 of adjacent long-span decking panels. As can be seen in FIGS. 1 and 2, the hook 42 is positioned above tab 64 and the tab 44 is positioned above hook 62.

Figure 6:
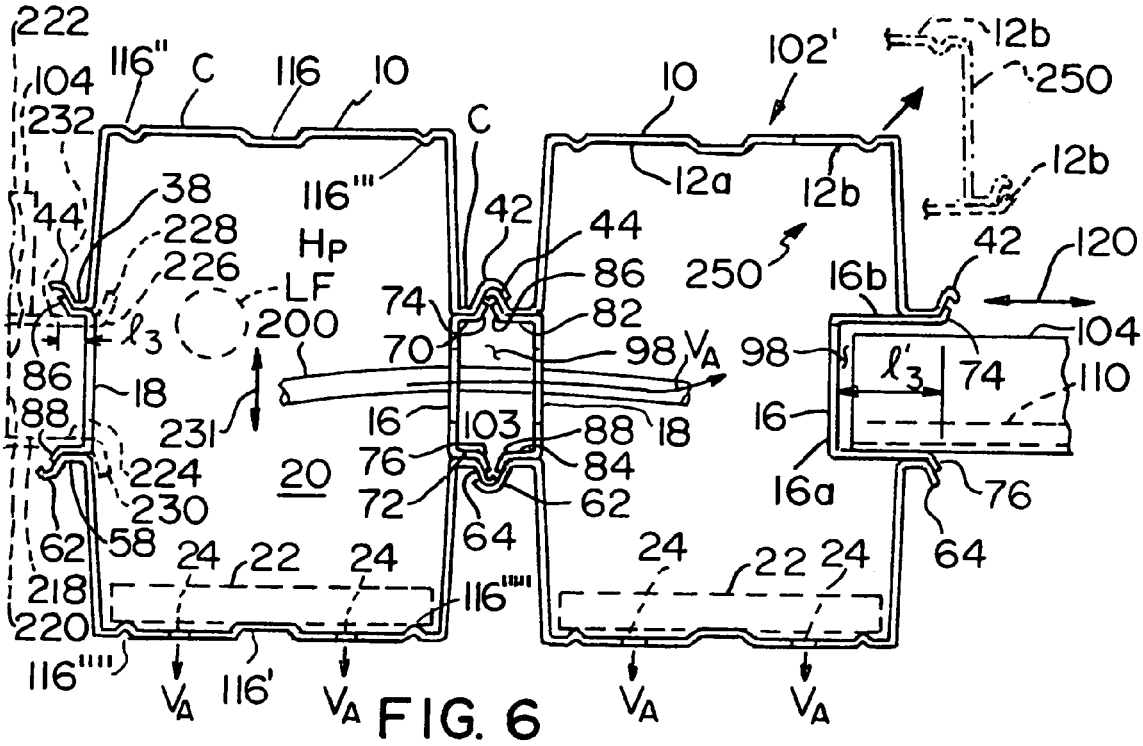
FIG. 6 is an end elevational view of a decking system made in accordance with the present invention.
Figure 9:
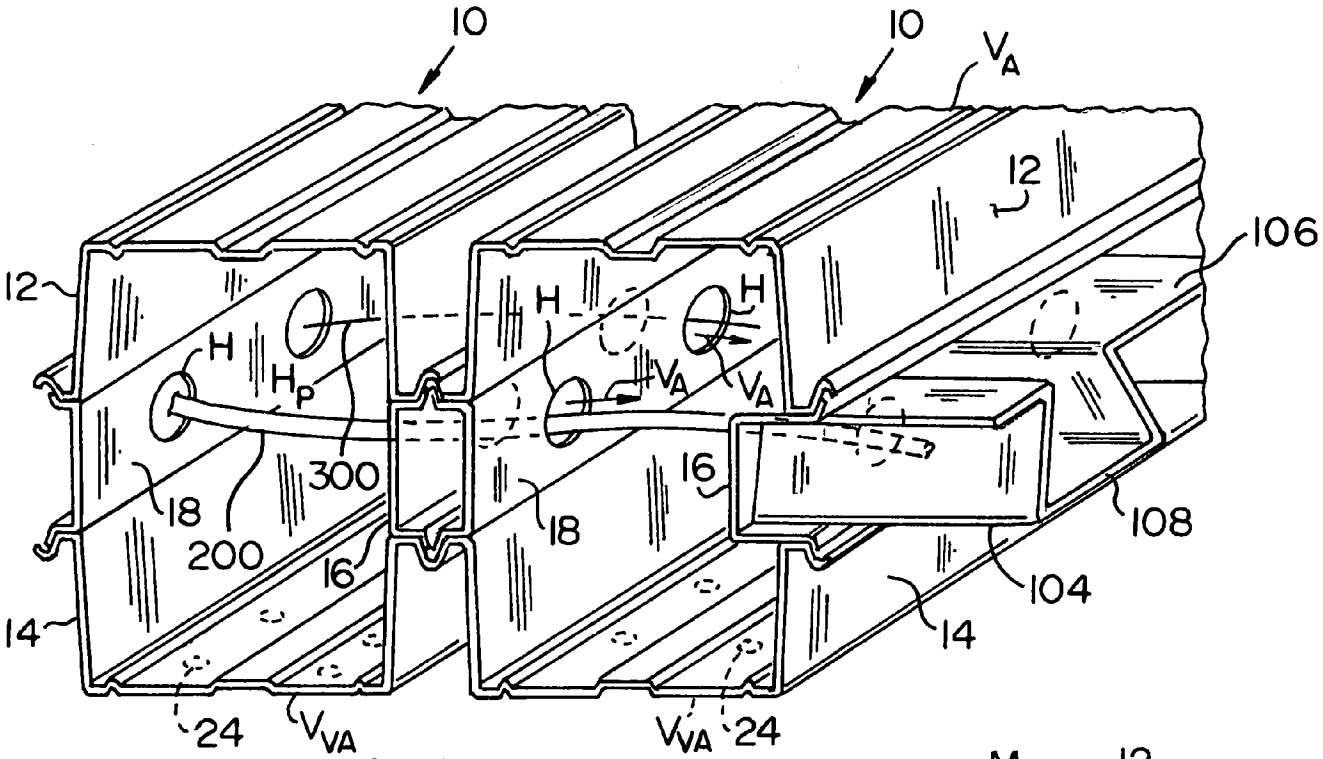
FIG. 9 is a top perspective view of the decking system shown in FIG. 6.

Each of the first panel section 12, second panel section 14, first channel 16 and second channel 18 has a depth. The first panel section 12 has a depth of $d_1$. The first channel 16 and second channel 18 have a depth of $d_2$ and the second panel section 14 has a depth of $d_3$. Preferably, the depths $d_1$ and $d_3$ are no more than 8 inches, although the depth can be any value. Typical depths of $d_1$ and $d_3$ are, for example, 3 inches, 4½ inches, 6 inches and 7½ inches. Further, the depth $d_2$ of the first channel 16 and second channel 18 can be any value but preferably greater than 1 inch and one of the preferred depths is 6 inches. The width W of the decking panel can be any value, such as 18 inches, the lengths $l_1$ and $l_2$ of top member 28 and each bottom member 48 can be any value, such as on the order of 14½ inches. The dimensions $l_3$ of legs 70, 72, 82 and 84 of the channel pieces can be any value, such as 1½ inches or 3 inches. More particularly, as shown in FIG. 1, the dimensions $l_3$ of legs 70, 72, 82 and 84 are preferably equal to the lengths of flanges 34, 38, 54 and 58, although the dimensions $l_3$ can be longer (as shown in FIGS. 6 and 9) or shorter than the flange lengths. Preferably, the first panel section 12, the second panel section 14, the first channel 16 and the second channel 18 are made by roll forming. Typically, the decking panel is made of light gauge steel.

The panel section 68 and legs 70 and 72 of the first channel 16 and the panel section 80 and legs 82 and 84 of the second channel 18 define a first cavity 98 and second cavity 100 respectively. These cavities are outwardly extending from the decking panel body, as shown in FIG. 1.

In another arrangement, as shown in FIG. 1, the second panel 14 may be replaced by a substantially flat plate P, with or without hooks 62 and tabs 64.

Figure 3:
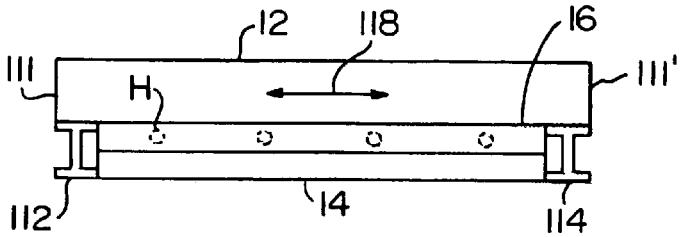
FIG. 3 is a side elevational view of a decking system incorporating the decking panel shown in FIG. 1 made in accordance with the present invention.

Referring now to FIG. 3, the decking panel 10, in one embodiment, which is similar to the embodiment shown in FIG. 1, is adapted to extend along a longitudinal axis and is supported at its opposite ends 111 and 111' by a first support 112 and second support 114. Ends 111 and 111' are defined on the first panel section 12. These supports 112 and 114 can be steel beams or load-bearing supports, which are spaced a predetermined distance. In one arrangement, the first panel section 12 extends along a length greater than first channel 16, second channel 18 (not shown) and the second panel section 14. The first panel section 12 extends above the supports 112 and 114 while the second panel section 14, first channel 16 and second channel 18 (not shown) extend downwardly from support surfaces of the supports 112 and 114. This arrangement is used to support at least one decking panel 10, but preferably is used to support a plurality of interconnected decking panels 10. End 111 contacts a support surface of the support 112 and end 111' contacts a support surface of the support 114. In other words, the first panel section 12 has a first length and the second panel section 14 has a second length, which is the same as the length of the first channel 16 and the second channel 18. The first length is greater than the second length. In another embodiment, the panel sections 12 and 14 and the channels 16 and 18 can be the same lengths. It is believed that a decking panel 10 made in accordance with the present invention out of 14 gauge steel and having depths $d_1$, $d_2$, $d_3$ of 7½ inches, 6 inches and 7½ inches, respectively, can span further than the prior art having the same gauge described in U.S. Pat. No. 5,205,098 for the same load. This is based upon a panel width as described above.

Figure 5:
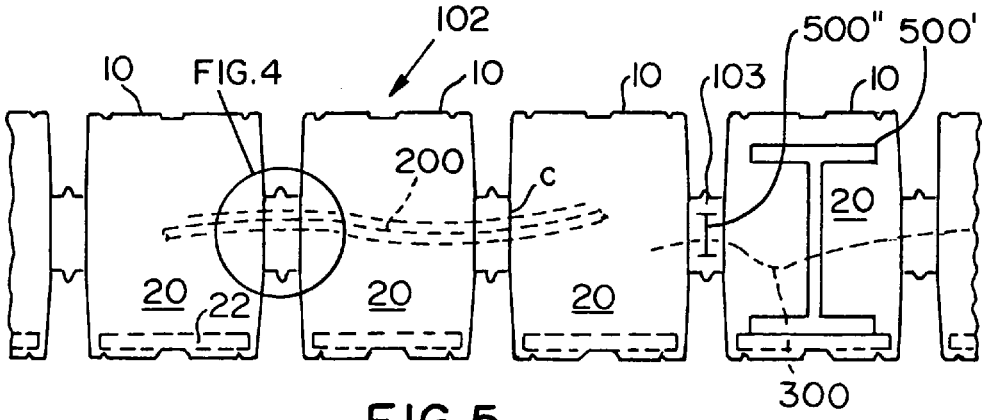
FIG. 5 is an end elevational view of a plurality of decking panels shown in FIG. 1 coacting with each other to make a decking system.
Figure 8:
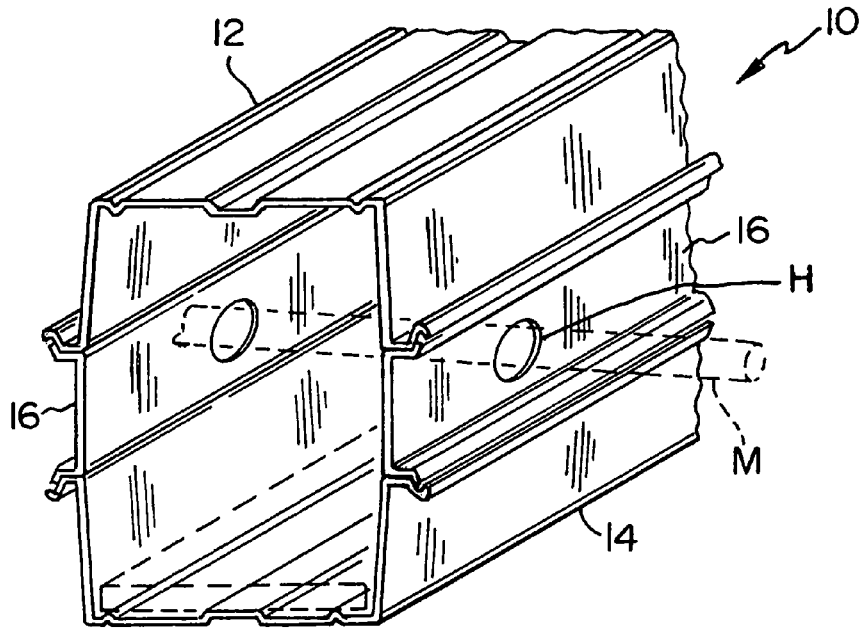
FIG. 8 is a top perspective view of the decking panel shown in FIG. 1.

Referring to FIGS. 4 and 5, a plurality of decking panels 10 can be assembled together by engaging respective male and female connectors. Specifically, the female connectors 42 engage with or receive respective ones of the male connectors 44 of an adjacent decking panel 10. Although the figures show one type of male and female connector, other types may be used, such as dove-tail side laps or standing seam laps, etc. Further, it is contemplated that adjacent panels 10 may be secured to each other without the need of male and female connectors, such as through simple overlaps. Likewise, the female connectors 62 of a decking panel 10 engage with respective ones of the male connectors 64 of an adjacent decking panel 10. In other words, adjacent first channels 16 and second channels 18 are secured via their respective legs 70, 72, 82 and 84. These adjacent connectors mate with each other and define a cell C having a cavity 103. Thus, adjacent decking panels 10 are secured to one another. Conduit and wiring, etc., may be passed between respective cavities 103 and 20 by way of openings H (shown in phantom in FIG. 3) in the respective panel sections 68 and 80 of the first channels 16 and the second channels 18. The openings H can be provided at the factory. FIG. 8 shows a decking panel 10 having a hole H. A structural member M shown in phantom in FIG. 8 can pass through both holes H and extend laterally from the decking panel for added support. Further referring to FIG. 12, a similar structural member M may extend laterally through the spaces defined by channels 16' and 18'. A representation of conduit or piping 200 and wiring 300 passing through cavities 103 and 20 is shown in FIG. 5.

Figure 7:
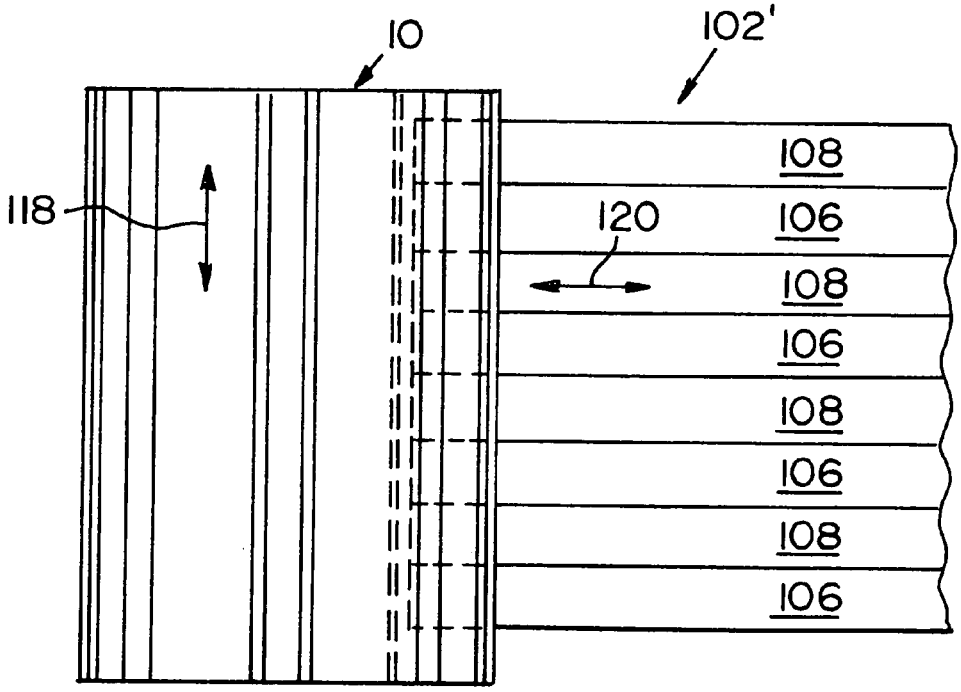
FIG. 7 is a top plan view of the decking system shown in FIG. 6.

Referring now to FIGS. 6, 7 and 9, a unique decking system 102' can be formed incorporating on its ends one or a plurality of decking panels 10 wherein the cavity 103 of one of the first channel 16 or the second channel 18 receives a secondary support member 104 such as a corrugated member. The secondary support member 104 will be supported at its opposite ends preferably by a cavity 103 of a respective decking panel 10. Preferably, the ends of the secondary support member 104 are fixedly secured to the respective first channel 16 or second channel 18 by fasteners, welding, gluing, etc. Only one side of the decking system 102' is shown. However, it is to be understood that the opposite end of secondary support member 104 (not shown) is received by a cavity 100 of a second channel 18 of a decking panel 10 spaced a distance apart in the longitudinal axis 120 from cavity 98 shown in FIG. 6. As can be seen, the length $l_3'$ of the receiving channel (for example 3 inches) may be greater than $l_3$ of a non-receiving channel (for example 1½ inches). One type of secondary support member 104 can be profiled roof deck although the secondary support member 104 need not be limited to that structure. The secondary support member 104 can include an arrangement having a plurality of spaced apart ribs 106 which are separated by flat or spacer sections 108. The ribs can take the form of a dovetail profile as shown in FIG. 9. However, the secondary support members can be any type of decking. Like decking panel 10, insulation or sound-absorbing material 110 may be provided with the support member 104 for soundproofing, along with perforations.

The decking system 102' provides a unique appearance, that of a coffered ceiling, and strength characteristics of a two-way supporting structure which are not present in present decking systems. Stiffeners 116, 116', 116", 116''', 116'''', 116''''' can be provided in the first panel section 12 and second panel section 14 for improved strength whether the decking panel 10 is used in decking panel system 102 or decking panel system 102'. Furthermore, the decking system 102' results in the decking panels 10, including the first channel 16 and the second channel 18, extending along a first longitudinal axis 118 between the first support or structural element 112 and the second support or structural element 114, while the support member ribs 106 extend along a second, transverse, longitudinal axis 120. This results in a strong decking arrangement where structural stiffening support is provided in two directions as represented by longitudinal axes 118 and 120. It is believed that to facilitate construction, panel section 12 and the channels 16 and 18 can be segments including a separate segment 250. Removal of the segment 250 creates an opening for easy receipt of the secondary support member 104 by the channel 16 or 18. In this arrangement as shown in FIG. 6, first panel section 12 includes segments 12*a* and 12*b* and first channel 16 includes segments 16*a* and 16*b*. Segment 250 includes segments 12*b* and 16*b*. In operation, the secondary support member 104 is set in place with segment 250 removed. The segment 250 is then secured to the portion of the first panel section 12*a* and the portion of the first panel section 16*a*, as shown.

Another advantage of the present invention as shown in FIGS. 2 and 4 is that the legs 70 and 82 include an aligning distance 122 and legs 72 and 84 include an aligning distance 124. This aligning distance which results in the coaction of respective tabs 74, 76, 86 and 88 with respective hooks 42 and 62 and/or tabs 44 and 64 enables the first channel and second channel to be properly aligned with first panel section 12 and second panel section 14. Examples of the aligning distances 122 and 124 are 1½ inches.

By providing the unique arrangement of hooks/tabs as described, the manufacture of the decking panel is simple and quick. Initially, all of the first panel sections 12, second panel sections 14, first channel 16 and second channel 18 can be preformed. Then the respective tabs of the first channel 16 and the second channel 18 engage or coact with respective hooks 42 or tabs 44 resulting in the first panel section 12 and first channel 16 and second channel 18 being properly aligned. These components are then fastened to each other either by welding, gluing, screws or other types of fastening arrangements to form a sub-assembly. Then the respective flanges and tabs of the second panel section 14 engage with the tabs of the first channel 16 and second channel 18, which are not secured to the first panel section 12 as similarly described above. The first channel 16 and second channel 18 are then secured to the second panel section 14 via welding fasteners or any other means to secure the two members together. The decking panel can be manufactured at a factory, off-site, or manufactured on-site in this manner.

Figure 10:
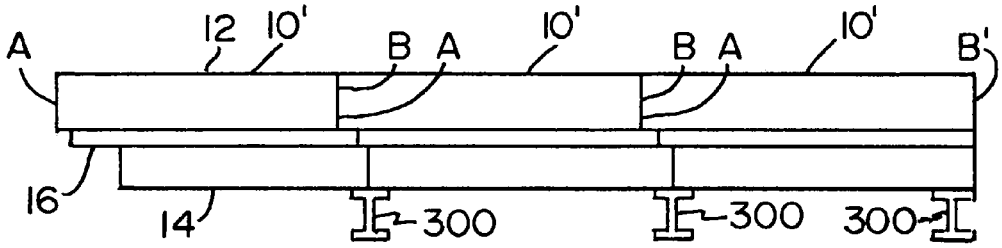
FIG. 10 is a side elevational view of an arrangement of the decking system similar to FIG. 3.

FIG. 10 shows a decking system similar to that shown in FIG. 3 where like reference numbers are used for like elements. Specifically decking panels 10' extend along a longitudinal area and have their respective ends supported by supports 300. As can be seen, the panels 10' are similar to panel 10 except the top hat or first panel section 12 is longitudinally offset from the bottom hat or the second panel section 14 and longitudinally offset from the channels 16 and 18 (not shown), so that respective ends A and B of the panels 10' mate or interlock with each other. Further, the ends A and B may abut each other. One of the panels 10" can be such that the panel section 12 and panel section 14 are different longitudinal lengths so that an exposed end B' is not offset. The purpose of this arrangement is to align adjacent ends of the panels 10' so that respective hooks 42 and 62 and tabs 44 and 64 of the longitudinally extending panels 10' engage and align with each other.

Figure 11:
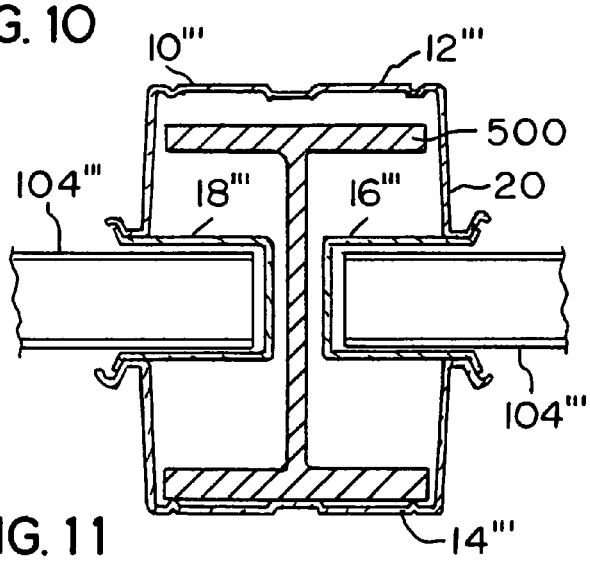
FIG. 11 is a cross-sectional view of a decking panel made in accordance with the present invention.

FIG. 11 shows another embodiment of the present invention wherein a framing member or stiffener 500, such as a steel beam, is received within cavity 20 of a panel 10'''. The panel includes a top hat or first panel section 12''', a bottom hat or second panel section 14''', and a first channel 16''' and a second channel 18''' similar to that previously described. Secondary support members 104''' are received by the first channel 16''' and second channel 18'''. Referring back to FIG. 5, a stiffener or structural member 500' or 500", such as a steel beam, can be received by cavities 20 or 103.

Figure 12:
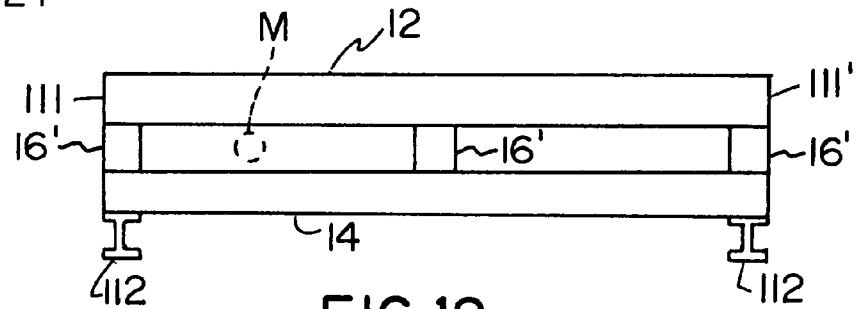
FIG. 12 is a side elevational view of a decking system similar to FIG. 3.

Referring to FIG. 12, the decking panel 10 is adapted to extend along a longitudinal axis and is supported at its opposite ends 111 and 111' by a first support 112 and a second support 114. In this arrangement, the first panel section 12 and the second panel section 14 are the same length. Also, the channel sections 16' and 18' (not shown) are the same as channel sections 16 and 18 except they are shorter in length than the panel sections 12 and 14 and longitudinally spaced apart defining spaces or openings between two adjacent channel sections 16' or 18' in lieu of holes or openings H formed in the channels 16 and 18 as previously described so as to provide access to the cavity of cell C. Like channel sections 16 and 18, legs of channels 16' and 18' coact with respective flanges 34, 38, 54 and 58 and the first panel section 12 and the second panel section 14 are attached to the respective channels 16' and 18' similarly as channels 16 and 18 are secured to first panel section 12 and second panel section 14. These spaces or openings are for receipt of conduit, piping or wiring as previously described.

Referring back to FIG. 6, decking system 102' can also include a channel 218, shown in phantom, in lieu of channel 18. The channel 218 includes a C-shaped body 220 that includes a panel section 222 having two depending legs 224 and 226. Tabs 228 and 230 depend from legs 224 and 226, respectively. The legs 224 and 226 coact with flanges 38 and 58. Further, the legs 224 and 226 are fixedly secured to the flanges 38 and 58, such as previously described. The tabs 228 and 230 are adapted to abut against legs 32 and 52.

As can be seen by the leftmost channel 10 in FIG. 6, the channel 218 faces inwardly toward the cavity 20 and central axis 231, as opposed to channel 16 facing away from the cavity 20 (and the central axis 231). Hence, channel 218 forms a ledge wherein an upper surface 232 of the leg 226 is adapted to have a secondary support member 104 rest or be supported thereon or be secured thereto, as opposed to being received within the first cavity 98 of the channel 16.

A further advantage of the present invention is that a network can be developed wherein respective decking panels 10 can be in fluid communication with each other via cavities 103 and holes H. In this arrangement, a ventilation system can be provided whereby high pressure air Hp can be provided into one of the decking panels 10 and the ventilation air VA flows out perforations and into other deck panels 10 via cavities 103 through holes H. In other words, adjacent decking panels 10 are in fluid communication with each other whereby the decking system forms a plenum. Further, the present invention can also provide lighting by placing lighting fixtures LF in the cavity 20, permitting light emitted by the lighting fixture to pass through the perforation 24 and light the area below. Hence, the present invention not only provides decking support but can also provide a lighting system and/or a ventilation system.

While a specific embodiment of the invention has been described in detail, it will be appreciated by those skilled in the art that various modifications and alternatives to those details could be developed in light of the overall teachings of the disclosure. The presently preferred embodiment described herein is meant to be illustrative only and not limiting as to the scope of the invention which is to be given the full breadth of the appended claims and any and all equivalents thereof.

The invention claimed is:

1. A long-span decking panel, comprising:

a first panel section having a first open channel, a first side flange integrally extending from a first edge of the first open channel and a second side flange integrally extending from a second edge of said first panel section;

a second panel section having a second open channel, a first side flange integrally extending from a first edge of said second open channel and a second side flange integrally extending from a second edge of the second open channel;

a first channel having a panel and two depending legs; and a second channel having a panel and two depending legs, wherein said first side flange of said first panel section and said first side flange of said second panel section coact with respective depending legs of said first channel, and said second side flange of said first panel section and said second side flange of said second panel section coact with respective depending legs of said second channel, wherein said first panel section and said second panel section are attached to said first channel and said second channel, so that said first panel section, second panel section, first channel and said second channel form a cell, and wherein said first channel and said second channel are disposed between said first panel section and said second panel section.

2. A long-span decking panel as claimed in claim 1, wherein said first panel section has a first end for contacting a first support surface and a second end for contacting a second support surface, said first panel section having a first length, and said second panel section having a second length, said second length shorter than the first length such that the second panel section, said first channel and said second channel extend below said first support surface and said second support surface when said first panel section is supported thereupon.

3. A long-span decking panel as claimed in claim 1, wherein said first side flange of said first panel section defines a hook and said second side flange of said first panel section defines a tab.

4. A long-span decking panel as claimed in claim 3, wherein said first side flange of said second panel section defines a tab and said second side flange of said second panel section defines a hook.

5. A long-span decking panel as claimed in claim 4, wherein said first channel legs and said second channel legs further include tabs extending therefrom, said tabs coacting with said respective areas of said hooks and said tabs of said first panel section and said second panel section.

6. A long-span decldng panel as claimed in claim 1, wherein said long-span decking panel includes a first side that incorporates a first portion of said first panel section, a first portion of said first channel and a first portion of said second panel section and a second side that incorporates a second portion of said first panel section, a second portion of said second channel and a second portion of said second panel section.

7. A long-span decking panel as claimed in claim 6, wherein said first side extends along a first surface and said second side extends along a second surface.

8. A long-span decking panel as claimed in claim 7, wherein said legs of said first channel and said legs of said second channel coact with said respective portions of said first panel section and said second panel section so that said first side extends along the first surface and said second side extends along the second surface.

9. A long-span decking panel as claimed in claim 1, wherein said first channel includes a first cavity defined by said panel and said depending legs of said first channel and said second channel includes a second cavity defined by said panel and depending legs of said second channel.

10. A long-span decking panel as claimed in claim 1, wherein said first panel section, second panel section, first channel and second channel comprise light gauge steel.

11. A long-span decking panel as claimed in claim 1, wherein said first panel section is longitudinally offset from said second panel section.

12. A long-span decking panel as claimed in claim 11, wherein the first panel section and said second panel section are longitudinally offset from said first channel and said second channel.

13. A long-span decking panel as claimed in claim 1, wherein said cell defines a cavity where at least one of said first channel or said second channel comprises an opening whereby access is provided to the cavity of the cell, said opening is adapted to permit conduit, piping or wiring to pass from said cell through the opening.

14. A long-span decking panel as claimed in claim 1, further comprising a structural member received within a cavity defined by said cell.

15. A long-span decking panel as claimed in claim 1, further comprising a lighting fixture provided with said cell and perforations provided in said cell, whereby when light is emitted by said light fixture, the light passes through the perforations.

16. A long-span decking panel, comprising:

a first panel section having a first open channel, a first side flange integrally extending from a first edge of the first open channel and a second side flange integrally extending from a second edge of said first panel section;

a second panel section having a second open channel, a first side flange integrally extending from a first edge of said second open channel and a second side flange integrally extending from a second edge of the second open channel;

a first channel having a panel and two depending legs; and a second channel having a panel and two depending legs, wherein said first side flange of said first panel section and said first side flange of said second panel section coact with respective depending legs of said first channel, and said second side flange of said first panel section and said second side flange of said second panel section coact with respective depending legs of said second channel, wherein said first panel section and said second panel section are attached to said first channel and said second channel, so that said first panel section, second panel section, first channel and said second channel form a cell, wherein said long-span decking panel includes a first side that incorporates a first portion of said first panel section, a first portion of said first channel and a first portion of said second panel section and a second side that incorporates a second portion of said first panel section, a second portion of said second channel and a second portion of said second panel section, and wherein said first side includes a first male connector and a spaced first female connector extending therefrom, and said second side includes a second male connector and a spaced second female connector extending therefrom, wherein said first male connector and second male connector are adapted to mate with respective said first female connector and said second female connector of adjacent ones of said long-span decking panels.

17. A long-span decking panel as claimed in claim 16, wherein said first male connector is positioned above said first female connector member and said second female connector is positioned above said second male connector.

18. A long-span decking panel as claimed in claim 16, wherein said first female member and said second female member each comprise hooks and said first male member and said second male member comprise tabs adapted to be received by said hooks.

19. A long-span decking panel as claimed in claim 18, wherein said respective hooks are defined by at least a portion of respective areas of said first panel section and said second panel section and wherein said respective tabs are defined by at least a portion of respective areas of said first panel section and said second panel section.

20. A long-span decking panel as claimed in claim 19, wherein said respective hooks are further defined by at least a portion of said first channel and said second channel, and said respective tabs are defined by at least a portion of said first channel and said second channel.

21. A decking system, comprising:

at least two horizontally disposed structural supporting elements spread a predetermined distance apart and at least one long-span decking panel, said long-span decking panel comprising:

a first panel section having a first open channel, a first side flange integrally extending from a first edge of the first open channel and a second side flange integrally extending from a second edge of said first panel section, said first panel section has a first end and a second end, said first panel section having a first length;

a second panel section having a second open channel, a first side flange integrally extending from a first edge of said second open channel and a second side flange integrally extending from a second edge of the second open channel, said second panel section having a second length;

a first channel, having a panel and two depending legs; and a second channel having a panel and two depending legs, wherein said first side flange of said first panel section and said first side flange of said second panel section coact with respective ones of said depending legs of said first channel, and said second side flange of said first panel section and said second side flange of said second panel section coact with respective ones of said depending legs of said second channel, wherein said first panel section and said second panel section are attached to said first channel and said second channel, so that said first panel section, second panel section, first channel and said second channel form a cell, said long-span decking panel having opposite ends, wherein said opposite ends of said long-span decking panel rest on respective ones of said structural elements.

22. A decking system as claimed in claim 21, wherein said at least one decking panel further comprises:

a hook defined on said first side flange of said first panel section;

a tab defined on said second side flange of said first panel section;

a tab defined on said first side flange of said second panel section; and a hook defined on said second side flange of said second panel section.

23. A decking system as claimed in claim 22, wherein said decking system comprises a plurality of said long-span decking panels, wherein adjacent areas of said long-span decking panels are secured to each other via the mating of respective areas of said hooks and said tabs of said respective adjacent long-span decking panels.

24. A decking system as claimed in claim 23, wherein each of said adjacent decking panels are in fluid communication with each other, whereby said decking system forms a plenum.

25. A decking system as claimed in claim 22, wherein said first channel legs and said second channel legs further include tabs extending therefrom, said tabs coacting with said respective areas of said hooks and said tabs of said first panel section and second panel section.

26. A decking system as claimed in claim 21, wherein said decking system comprises a plurality of said long-span decking panels, wherein each of said long-span decking panels further comprises:

a first side that incorporates a first portion of said first panel section, said first channel and a first portion of said second panel section;

a second side that incorporates a second portion of said first panel section, said second channel and a second portion of said second panel section, wherein said first side extends along a first surface and said second side extends along a second surface, said first side includes a first male connector and a spaced first female connector extending therefrom, and said second side includes a second male connector and a spaced second female connector extending therefrom, wherein said first male connector and second male connector are adapted to mate with respective said first female connector and said second female connector of adjacent ones of said long-span decking panels, said first male connector is positioned above said first female connector member and said second female connector is positioned above said second male connector and wherein respective areas of said first male connector, said first female connector, said second male connector and second female connector of adjacent long-span decking panels mate with each other.

27. A decking system as claimed in claim 21, wherein each of said first channel includes a first cavity defined by said panel and said depending legs of said first channel and wherein each of said second channel includes a second cavity defined by said panel and depending legs of said second channel.

28. A decking system as claimed in claim 27, further comprising a secondary support member having an end, said end received within the cavity of one of said first channel and said second channel.

29. A decking system as claimed in claim 28, wherein said at least one long-span decking panel extends in a first longitudinal direction between said structural supporting elements and said secondary support member comprises decking having at least one rib, wherein said rib extends in a second longitudinal direction, said second longitudinal direction transverse to said first longitudinal direction, said first channel and said second channel extend along the first longitudinal direction, wherein said decking system provides structural support in both the first longitudinal direction and the second longitudinal direction.

30. A decking system as claimed in claim 28, wherein a portion of at least one of said first panel section and one of said first channel or said second channel defines a separate segment.

31. A decking system as claimed in claim 27, wherein said decking system comprises a plurality of said long-span decking panels and said adjacent decking panels are secured to each other through said legs of adjacent ones of said first channel and said second channel, said secured adjacent first channel and said second channel defining a cell member having a cavity defined by the first cavity and the second cavity of said secured adjacent first channel and second channel.

32. A decking system as claimed in claim 31, further comprising a structural member received within the cavity defined by said cell member.

33. A decking system as claimed in claim 31, wherein said cell member is in fluid communication with said cells of said decking panels forming said cell member, said decking panels having perforations so that ventilated air can pass through said cells and cell members and out said perforations.

34. A long-span decking panel as claimed in claim 21, wherein said first side flange of said first panel section defines a hook and said second side flange of said first panel section defines a tab.

35. A method for assembling a long-span decking panel comprising the steps of:

providing a first panel section having a first open channel, a first side flange integrally extending from a first edge of the first open channel and a second side flange integrally extending from a second edge of said first panel section, wherein said first side flange of said first panel section defines a hook and said second side flange of said first panel section defines a tab;

providing a second panel section having a second open channel, a first side flange integrally extending from a first edge of said second open channel and a second side flange integrally extending from a second edge of the second open channel, wherein said first side flange of said second panel section defines a tab and said second side flange of said second panel section defines a hook;

providing a first channel having a panel and two depending legs, each of said legs having a depending tab;

providing a second channel having a panel and two depending legs, each of said legs having a depending tab;

coacting said tabs of said first channel and said second channel with said respective hook and tab of said first panel section;

attaching said first channel and said second channel to said first panel section by securing areas of one of said first channel legs and one of said second channel legs to respective said first side flange and second side flange of said first panel section;

coacting said tabs of said first channel and said second channel with said respective hook and tab of said second panel section; and attaching said first channel and said second channel to said second panel section, such that said first channel and said second channel are disposed between said first panel section and said second panel section, by securing areas of one of said first channel legs and one of said second channel legs which are not secured to the first panel section, to respective said first side flange and said second side flange of said second panel section.

36. A method for assembling a long-span decking system, comprising the steps of:

providing a plurality of long-span decking panels, each of said panel comprises:

a first panel section having a first open channel, a first side flange integrally extending from a first edge of the first open channel and a second side flange integrally extending from a second edge of said first panel section;

a second panel section having a second open channel, a first side flange integrally extending from a first edge of said second open channel and a second side flange integrally extending from a second edge of the second open channel;

a first channel having a panel and two depending legs; and a second channel having a panel and two depending legs, wherein said first side flange of said first panel section and said first side flange of said second panel section coact with respective ones of said depending legs of said first channel, and said second side flange of said first panel section and said second side flange of said second panel section coact with respective ones of said depending legs of said second channel, wherein said first panel section and said second panel section are attached to said first channel and said second channel, so that said first panel section, second panel section, first channel and said second channel form a cell; and securing adjacent ones of said long-span decking panels by mating respective ones of said first panel section first side flange with a first panel section second side flange of an adjacent panel and mating ones of said second panel section first side flange with a second panel section second side flange of the adjacent panel.

37. A method for assembling a long-span decking system as claimed in claim 36, further comprising the steps of providing a secondary support member received by one of said first channel and said second channel, said secondary support member extends along a first longitudinal axis, each of said long-span decking panels extends along a second longitudinal axis that is transverse to the first longitudinal axis.

38. A long-span decking panel, comprising:

a first panel section having a first open channel, a first side flange integrally extending from a first edge of the first open channel and a second side flange integrally extending from a second edge of said first panel section;

a second panel section having a second open channel, a first side flange integrally extending from a first edge of said second open channel and a second side flange integrally extending from a second edge of the second open channel; and a plurality of channels each having a panel and two depending legs, wherein said first side flange of said first panel section and said first side flange of said second panel section coact with respective ones of said depending legs of at least two of said plurality of channels and said second side flange of said first panel section and said second side flange of said second panel section coact with respective ones of said depending legs of at least two of said plurality of channels, wherein the first panel section and the second panel section are attached to respective ones of said plurality of channels, so that said first panel section, second panel section, and said channels form a cell having a cavity, wherein said channels coacting with said first side flanges of said first panel section and said second panel section are longitudinally spaced apart defining an opening between two adjacent channels and said channels coacting with said second side flanges of said first panel section and said second panel section are longitudinally spaced defining an opening between two adjacent channels whereby access is provided to the cavity of said cell through said openings are adapted to permit conduit, piping or wiring to pass from said cell through the openings, and wherein said first channel and said second channel are disposed between said first panel section and said second panel section.

39. A long-span decking panel, comprising:

a first panel section having a first open channel, a first side flange integrally extending from a first edge of the first open channel and a second side flange integrally extending from a second edge of said first panel section;

a second panel section having a second open channel, a first side flange integrally extending from a first edge of said second open channel and a second side flange integrally extending from a second edge of the second open channel;

a first channel having a panel and two depending legs; and a second channel having a panel and two depending legs, wherein said first side flange of said first panel section and said first side flange of said second panel section coact with respective depending legs of said first channel, and said second side flange of said first panel section and said second side flange of said second panel section coact with respective depending legs of said second channel, wherein said first panel section and said second panel section are attached to said first channel and said second channel, so that said first panel section, second panel section, first channel and said second channel form a cell, wherein said first channel faces toward a central axis passing through said decking panel, so that one of said depending legs of said channel defines a ledge to support a secondary supporting member.

40. A long-span decking panel, comprising:

a first panel section having a first open channel, a first side flange integrally extending from a first edge of the first open channel and a second side flange integrally extending from a second edge of said first panel section;

a second panel section;

a first channel having a panel and two depending legs; and a second channel having a panel and two depending legs, wherein said first side flange of said first panel section and said second panel section coact with respective ones of said depending legs of said first channel, and said second side flange of said first panel section and said second panel section coact with respective ones of said depending legs of said second channel, wherein said first panel section and said second panel section are attached to said first channel and said second channel, so that said first panel section, second panel section, first channel and said second channel form a cell, and wherein said first channel and said second channel are disposed between said first panel section and said second panel section.

41. A long-span decking panel as claimed in claim 40, wherein said second panel section is substantially flat.

* * * * *